US006223458B1

(12) United States Patent
Schwinkendorf et al.

(10) Patent No.: US 6,223,458 B1
(45) Date of Patent: May 1, 2001

(54) HARMONIC OPTIMIZATION TECHNOLOGY

(76) Inventors: Kevin Schwinkendorf, 1121 Pine; Steven P. Roblyer, 721 Snyder, both of Richland, WA (US) 99352

( * ) Notice: Subject to any disclaimer, the term of this patent is extended or adjusted under 35 U.S.C. 154(b) by 0 days.

(21) Appl. No.: 09/285,946

(22) Filed: Apr. 1, 1999

Related U.S. Application Data

(63) Continuation-in-part of application No. 09/053,912, filed on Apr. 2, 1998, now abandoned, and a continuation-in-part of application No. 08/846,375, filed on Apr. 30, 1997, now Pat. No. 5,798,473.

(51) Int. Cl.[7] ..... F41A 21/38
(52) U.S. Cl. ..... 42/1.06; 89/14.3; 42/75.02
(58) Field of Search ..... 89/14.2, 14.3, 89/14.4; 42/75.01, 75.02, 75.03, 76.01, 79, 97, 1.06

(56) References Cited

U.S. PATENT DOCUMENTS

| | | | |
|---|---|---|---|
| Re. 20,958 | 12/1938 | White | 42/79 |
| Re. 35,381 | 11/1996 | Rose | 89/14.3 |
| 592,437 | 10/1897 | Oberhammer . | |
| 1,892,522 | 12/1932 | White . | |
| 1,900,790 | 3/1933 | Brandt . | |
| 2,153,246 | 4/1939 | Gibson | 42/79 |
| 2,165,457 | 7/1939 | Cutts, Jr. | 89/14 |
| 2,191,484 | 2/1940 | Hughes | 89/14 |
| 2,302,699 | 11/1942 | Klipsch | 42/1 |
| 2,340,821 | 2/1944 | Russell | 42/76 |
| 2,372,568 | 3/1945 | Grigg | 42/75 |
| 2,428,232 | 9/1947 | Limon | 42/79 |
| 2,442,899 | 6/1948 | McAllister | 42/79 |
| 2,453,747 | 11/1948 | Egleson | 42/79 |
| 2,466,104 | 4/1949 | Hilburn | 42/79 |
| 2,499,428 | 3/1950 | Tiffany | 89/14 |
| 2,558,200 | 6/1951 | Schmeling | 42/79 |
| 2,589,738 | 3/1952 | Sedberry | 42/79 |
| 2,629,958 | 3/1953 | Roper | 42/79 |
| 2,656,637 | 10/1953 | Richards | 42/79 |
| 2,662,326 | 12/1953 | Powell | 42/79 |
| 2,668,479 | 2/1954 | Batten | 89/14 |
| 2,712,193 | 7/1955 | Mathis | 42/79 |
| 2,796,005 | 6/1957 | Shapel | 89/14 |
| 2,809,560 | 10/1957 | Matson | 89/14 |
| 2,953,972 | 9/1960 | Sorenson | 89/14 |
| 3,114,289 | 12/1963 | Aulabaugh | 89/14 |
| 3,161,979 | 12/1964 | Lowe | 42/79 |

(List continued on next page.)

FOREIGN PATENT DOCUMENTS

| | | |
|---|---|---|
| 588100 | 12/1959 | (CA) . |
| 127231 | 11/1919 | (GB) . |
| 594515 | 11/1947 | (GB) . |

*Primary Examiner*—Stephen M. Johnson
(74) *Attorney, Agent, or Firm*—Lieber, Ivey & Connor; Floyd E. Ivey

(57) ABSTRACT

A method and an apparatus or apparatus system for vibration control, by harmonic optimization technology, of vibrations in the cantilever or barrel, portion of a device from which a projectile is fired or launched along the centerline of the cantilever. More particularly this invention relates to rifles, where the rifle barrel is a cantilever portion, and methods and apparatus for increasing the accuracy of firing projectiles. The invention is principally directed to a method and apparatus including a mass device affixed to a flexible cylinder extension at the muzzle end, inertial mass devices, having combustion pressure reduction features, affixed intermediate the muzzle end and the cartridge chamber, and a spring suspension system between barrel and rifle stock affixed proximal to the cartridge chamber. This system decreases the angular dispersion of barrel vibrations at the muzzle resulting from the firing of projectiles through such barrels.

21 Claims, 8 Drawing Sheets

U.S. PATENT DOCUMENTS

| | | | | |
|---|---|---|---|---|
| 3,187,633 | | 6/1965 | Lanabe | 89/14 |
| 3,202,056 | | 8/1965 | Seeberger | 89/14 |
| 3,208,348 | | 9/1965 | Lee | 89/14 |
| 3,340,641 | | 9/1967 | Recker | 42/1 |
| 3,455,203 | | 7/1969 | Hillersdorf | 89/14 |
| 3,492,750 | | 2/1970 | Ashbrook | 42/79 |
| 3,496,667 | | 2/1970 | Lowry | 42/78 |
| 3,618,245 | | 11/1971 | Pruonto | 42/1 |
| 3,698,747 | | 10/1972 | Wing | 285/305 |
| 3,714,864 | | 2/1973 | Thierry | 89/14 |
| 3,732,778 | * | 5/1973 | Bettermann et al. | 42/1.06 |
| 4,341,283 | | 7/1982 | Mozzanti | 181/223 |
| 4,374,484 | | 2/1983 | Lekker | 89/143 |
| 4,392,413 | | 7/1983 | Govinn, Jr. | 89/14 |
| 4,436,017 | * | 3/1984 | Mohlin | 89/14.3 |
| 4,510,843 | | 4/1985 | Rabatin | 89/14.4 |
| 4,558,532 | | 12/1985 | Wright | 42/94 |
| 4,635,528 | | 1/1987 | McQueen | 89/14.3 |
| 4,726,280 | | 2/1988 | Frye | 89/16 |
| 4,813,333 | | 3/1989 | Garris | 89/14.3 |
| 4,869,151 | | 9/1989 | Chahin | 89/14.3 |
| 4,879,942 | | 11/1989 | Cave | 89/14.3 |
| 4,913,031 | * | 4/1990 | Bossard et al. | 89/14.3 |
| 4,971,208 | | 11/1990 | Reinfried | 211/64 |
| 5,058,302 | | 10/1991 | Minneman | 42/94 |
| 5,092,223 | | 3/1992 | Hudson | 89/14.2 |
| 5,105,717 | | 4/1992 | Pand | 89/14.3 |
| 5,119,716 | | 6/1992 | Bartolles | 89/14.3 |
| 5,173,563 | | 12/1992 | Gray | 42/94 |
| 5,279,200 | | 1/1994 | Rose | 89/14.3 |
| 5,798,473 | * | 8/1998 | Roblyer et al. | 89/14.3 |

* cited by examiner 40
41
64
8A
64
61
8
64
7
64

10
9A
9A
10
14
7
42
40
64
41
53
43
53
61
64

40
53
53
8A
53
53
53
7
53
53
43
8

40
61
44
53
42
41
53
53
43
53
46
44
53
48

HARMONIC OPTIMIZATION TECHNOLOGY

CONTINUATION IN PART APPLICATION

This is a Continuation In Part Application from the nonprovisional parent application 08/846,375 entitled HARMONIC OPTIMIZATION SYSTEM FOR RIFLES to Roblyer et.al. as filed Apr. 30, 1997, now U.S. Pat. No. 5,798,473 and from the Continuation In Part application Ser. No. 09/053,912 entitled HARMONIC OPTIMIZATION TECHNOLOGY FOR RIFLES to Roblyer et.al. as filed Apr. 2, 1998, now abandoned. The applicants request prosecution pursuant to 37 C.F.R. 1.53(b) and 1.78 and 35 U.S.C. 120. New matter added herein will be set out separately, for examination convenience, in a separate letter transmitted with this CIP application.

FIELD OF THE INVENTION

The present invention relates generally to apparatus with a cantilever portion from which a projectile is fired or launched along the centerline of the cantilever and in particular to the controlling of vibrations of the cantilever component of such an apparatus. More particularly this invention relates to rifles, where the rifle barrel is a cantilever portion, and methods and apparatus for increasing the accuracy of firing projectiles. The invention is principally directed to a method and apparatus including a mass device affixed to a flexible cylinder extension at the muzzle end, inertial mass devices affixed intermediate the muzzle end and the cartridge chamber, and a spring suspension system affixed proximal to the cartridge chamber. This system decreases the angular dispersion of barrel vibrations at the muzzle resulting from the firing of projectiles through such barrels.

BACKGROUND OF THE INVENTION

Accuracy and consistency in striking a target is a principal goal of marksmen in hobby and military applications. A non-military application involves rifle target shooting competitions. Methods and apparatus have been developed with the intent of reducing factors which adversely affect accuracy and consistency in the delivery of a projectile at a target. Several solutions have addressed the issue by modifying the barrel or cantilever portion of the device of concern. The focus of such changes have involved the positioning of a mass or muzzle brakes at the muzzle end of a rifle barrel and the use of bench rests during firing. Prior art notes two of the factors adversely affecting accurate rifle marksmanship to be barrel vibration and recoil with solutions posed in the form of modification of the barrel or cantilever portion of the projectile firing or launching mechanism and in the development or change of firearm supports. U.S. Pat. No. 5,279,200 of Jan. 18, 1994, reissued as U.S. Pat. No. RE 35,381 of Nov. 26, 1996 to Rose et. al. recites the state of the art relating to reduction of vibration in rifle barrels observing that with such advancements target pattern inconsistencies remained as an inherent characteristic of rifles. Such a characteristic applies, by extension, to the apparatus which incorporates a cantilever for final projectile travel and exiting in determining the projectile trajectory. The '200(RE 35,381) patent notes, for the rifle marksman, that inconsistencies are of particular concern in the firing of certain factory loaded cartridges from a firearm not designed specifically for use with that particular factory cartridge. The issue of matching a particular rifle with a particular cartridge, as a recognized method of adjusting vibration frequency so that the vibrational velocity is nearly stopped when the bullet exits the muzzle and increasing consistency, is addressed in the '200 patent. The patent to Rose, et. al, discloses the ability to match a rifle to a particular ammunition and that with appropriate system adjustments, of the position of a mass at the muzzle, to fire different factory loaded cartridges.

Rose, in the '200 patent, recites U.S. Pat. No. 4,726,280 to Frye disclosing a muzzle member at the muzzle end of a gun barrel. Although not stated in U.S. Pat. No. 4,726,280, it is generally understood that such a muzzle member may serve as a mass for the purpose of vibration dampening. The muzzle member is threaded onto the barrel, and is locked in place. Anschutz and Co. G.M.B., through the 1989 catalog of its distributor, Precision Sales International, Inc., of Westfield, Mass., discloses, at pages 11 and 16, barrel extensions for rifles that include removable weights. Although not stated in the 1989 catalog of Anschutz and Co. G.M.B., it is understood that varying such masses will enable a marksman to vary the dampening effect in relation to the barrel vibrations resulting from the discharge of different cartridges.

Prior art also addresses muzzle brakes in functioning to exhaust propulsion gases as a means of reducing recoil and of dissipating propulsion gases in a direction or directions other than out the muzzle of the barrel. Attention is called to U.S. Pat. Nos. 5,279,200(RE 35,381) to Rose; U.S. Pat. No. 4,879,942 to Cave and U.S. Pat. No. 5,092,223 to Hudson. The known muzzle brakes comprise a mass and are recognized to change vibration characteristics potentially performing a dampening function.

Firearm rests and supports may also perform a dampening or control function. U.S. Pat. No. 5,058,302 to Minneman, U.S. Pat. No. 4,971,208 to Reinfried et. al, U.S. Pat. No. 5,173,563 to Gray and U.S. Pat. No. 4,558,532 to Wright are noted. The foregoing patents and printed publications are provided herewith in an Information Disclosure Statement in accordance with 37 CFR 1.97 with the exception of the reference to Anschutz and Co. G.M.B. which has been obtained and submitted. Additional domestic and foreign patents and publications have been submitted in the prosecution of the parent application. This Continuation in part relies on and incorporates prior art as submitted and identified in Information Disclosure Statements in accordance with 35 CFR 1.97 in association with the parent application Ser. No. 08/846,375.

SUMMARY OF THE INVENTION

The present invention discloses a vibration control system developed by use of harmonic optimization technology (H.O.T.). The H.O.T. system addresses the improvement of rifle accuracy by controlling barrel vibration in a manner differing from approaches of other methods such as using extra heavy (bull) barrels, "tuning" cartridges with powder loads and bullet weight, or varying barrel vibration frequency with an adjustable mass at the muzzle.

Variations in either powder loads or bullet weights cause changes in muzzle velocities which result in different times between powder ignition and the time when the bullet leaves the muzzle. The barrel undergoes many complex and superimposed vibrations when the powder is ignited and the bullet is progressing down the barrel. Vibration dampening or minimization methods known in the prior art are directed to tuning the time the bullet leaves the muzzle with the barrel vibrational frequency. The intent of such tuning is to result in the bullet exiting from the muzzle at a time corresponding to a major vibrational mode at its position of extreme deflection.

A particular load will have some muzzle velocity variation from cartridge to cartridge, so that any variation in the angular deflection of the muzzle in time will result in a statistical variation in dispersion angle. Minimizing the time rate of change of the muzzle deflection, coupled to statistical variation in muzzle velocity, and thus the time of flight of the bullet to the exit point at the muzzle, will minimize group size making the rifle less sensitive to small variations in the bullet travel time. While this will reduce the group size of bullet impact, the point of impact may vary significantly with different loads and bullet weights inasmuch as the objective of the approach was to make the bullet exit the barrel while it was at the point of extreme deflection. This extreme deflection may direct the muzzle at different points of impact for different loads.

A system or apparatus for a rifle barrel, and other devices employing a cantilever portion from which a projectile is launched or fired, developed through a harmonic optimization technology achieves improved bullet accuracy by significantly reducing the magnitude of the barrel muzzle angular dispersion caused by vibrations. Thus, the specific sight-in for different loads will be more predictable, i.e., from exterior ballistics. Deviation of the point of impact from the ideal predictions of exterior ballistics will be minimized. Bullet accuracy will be less sensitive to variations in ammunition loads.

The vibrations affecting bullet accuracy are a superposition of many transverse vibrational modes that are initiated at a continuum of points along the barrel. The short-term vibrational response will include a particular solution arising from the specific characteristics of the driving function, but the vibrational response will rapidly transition into the natural vibrational modes for the barrel itself. Harmonic optimization technology recognizes that barrel vibration is unavoidable. This technology and invention focuses on control of barrel vibration in such a way as to minimize the dispersion angle at the muzzle, for all relevant time during the transit of a bullet, until the bullet leaves the barrel at the muzzle. The preferred embodiment of this invention addresses the short-term vibrational transient response of the barrel, in the vicinity of the muzzle, to the vibration caused by the combustion of a cartridge, in the cartridge chamber, and the transit of a bullet through the barrel. Another embodiment addresses the partial cycle of the lowest frequency mode and the higher-order vibrational harmonics of the barrel as presented in the parent application Ser. No. 08/846,775. This Continuation in part addresses the embodiment where the invention or system is optimized or tuned based on the short term vibrational transient response.

The present invention comprises an improvement to known vibration dampening systems or apparatus by first reducing vibrations at the muzzle by first partially decoupling and isolating the vibrations initiated in the barrel near the cartridge chamber or breach end of the barrel as a result of a launching and the transit of a projectile through the barrel, thereby reducing vibration transmission to the muzzle end of the barrel. The launching may be by, but need not be limited to, chemical, thermodynamic, or electromagnetic processes. Secondly, the vibrations are modified so that the angular dispersion at the muzzle, which gives final direction to the projectile, is minimized. This may be accomplished by a method which comprises tuning the barrel to produce a standing wave, corresponding to the frequency of the short term vibrational response, in response to barrel vibrations that bend the barrel proximal to the muzzle so that the dispersion angle at the muzzle remains nearly parallel with the bore axis. This method allows the projectile to exit the barrel at a point where the standing wave has maximum displacement or zero slope. In the preferred embodiment of the apparatus disclosed, the standing wave is produced by a harmonic oscillator and an inertial mass. However, it will be apparent to those skilled in the art that other hardware configurations will produce such a standing wave in response to the short term vibrational response of the barrel. The appended claims are therefore intended to cover all such configurations as fall within the true spirit and scope of the invention. Thirdly, the pressures of expanding gases on the back of the bullet as it exits the muzzle are reduced in order to prevent undue upset on the bullets' angle of flight and axis of rotation. Moreover, in devices such as rifles comprising a barrel and a rifle stock, said method further comprises the step of adjusting the vibrational boundary conditions between the barrel and the rifle stock. Thus bullet path dispersion is minimized, not just for a particular load, but for any load with variations in bullet weight and powder load. The impact location of a specific bullet weight and powder load will be primarily a vertical relationship to the point of aim which is based on the predictable trajectory of the bullet.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
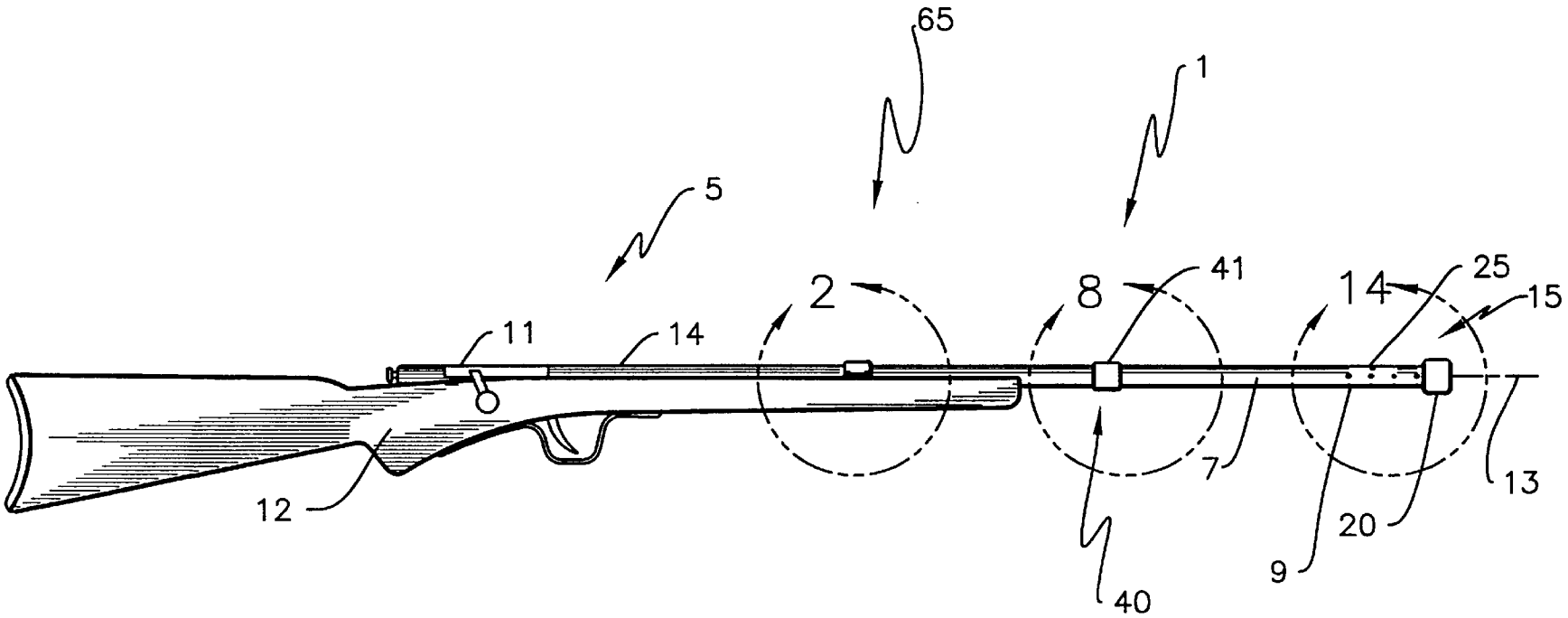
FIG. 1 is a side elevation of a rifle showing the positioning of the components of the harmonic optimization system for rifles including the harmonic oscillator, shown as detail 14, the inertial mass, shown as detail 8', and the barrel spring suspension system, shown as detail 2. The harmonic oscillator and inertial mass may be components affixed to the barrel or may be formed integral with the barrel.

The harmonic optimization technology vibration controlling system 1 disclosed herein is illustrated in FIG. 1 through FIG. 15 as applied to a rifle 5 having a barrel 7, a barrel bore 8, a muzzle 9, a cartridge chamber 11, a bore axis 13, a barrel surface 14 and a bore surface 8A. The cartridge chamber 11 is distal from the muzzle 9. The barrel 7 having a short term vibrational response, to the combustion of a cartridge in the cartridge chamber 11 and to the transit of a bullet through the barrel 7. The muzzle 9 having a dispersion angle relative to the bore axis 13. System components, in the preferred embodiment, include a harmonic oscillator 15, formed at or affixed by means at the barrel muzzle 9, the harmonic oscillator 15 having harmonic oscillator mass 20, wall thickness, material composition, extension length and flexible cylinder discontinuities. The harmonic oscillator 15 composed of a harmonic oscillator mass 20 and a flexible cylinder extension 25 of the muzzle 9. The harmonic oscillator 15 including harmonic oscillator mass 20 and flexible cylinder extension 25, as depicted in FIG. 1 and 14, 14A and 14B, may be formed integral with the machining or other formation of the barrel 7 or may be elements affixed to the barrel 7 in the form of components distinct from the manufacture of the barrel 7. The term 'affixed' used in conjunction with the harmonic oscillator 15, including harmonic oscillator mass 20 and flexible cylinder extension 25 , includes formation integral to the manufacturing of the barrel 7 as well as the attachment of elements or components inherently separate from the barrel 7. The harmonic oscillator 15 is tuned producing a standing wave, corresponding to the frequency of the short term vibrational response, between an inertial mass 40 and the harmonic oscillator mass 20, that bends the barrel 7 proximal to the muzzle 9, so that the muzzle dispersion angle is minimized. The first function of the harmonic oscillator 15 is to produce a torque, or moment, between the barrel muzzle 9 and the harmonic oscillator 15 in response to barrel 7 vibrations that bends the barrel 7 proximal to the muzzle 9 so that its dispersion angle at the muzzle 9 remains parallel with the bore axis 13. The bore axis 13 extends from the cartridge chamber 11 to the muzzle 9 centrally positioned along the barrel bore 8. Thus, the bullet path remains parallel to the bore axis 13 as it exits the muzzle 9.

The design parameters for the tuning of the harmonic oscillator 15 are mass (harmonic oscillator mass 20), flexible cylinder extension wall 27 thickness and material composition, flexible cylinder extension 25 length, and flexible cylinder discontinuities 30. Tuning may be accomplished by placement of the harmonic oscillator mass 20 and adjustment of the flexibility of the flexible cylinder extension 25, as for example, in the vertical and horizontal directions, by adjustment of one or more of wall thickness, material composition and length of the flexible cylinder extension 25. Flexible cylinder discontinuities 30 are composed of penetrations through the flexible cylinder extension wall 27, grooves in the flexible cylinder extension surface 28 or other artifacts or features which change the area moment of the flexible cylinder extension 25 relative to the area moment of the barrel 9 thus changing the relative flexibility and reflecting vibrational energy. The flexible cylinder discontinuities 30 may be penetrations through the flexible cylinder extension wall 27 from the flexible extension bore 26 to the flexible cylinder extension surface 28.

Figure 14:
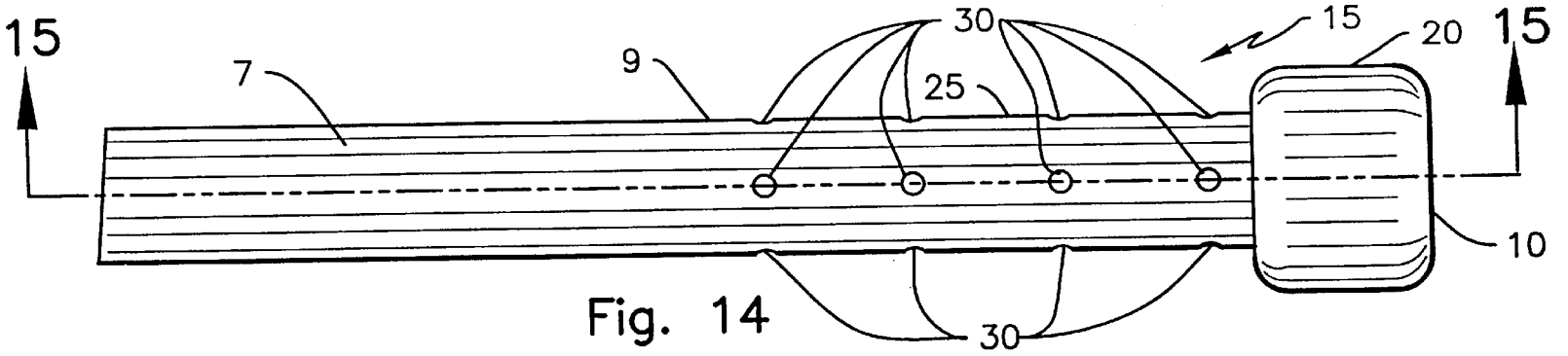
FIG. 14 shows the harmonic oscillator with harmonic oscillator mass, flexible cylinder extension, flexible cylinder extension wall, and flexible cylinder discontinuities with circular cross sections
Figure 14A:
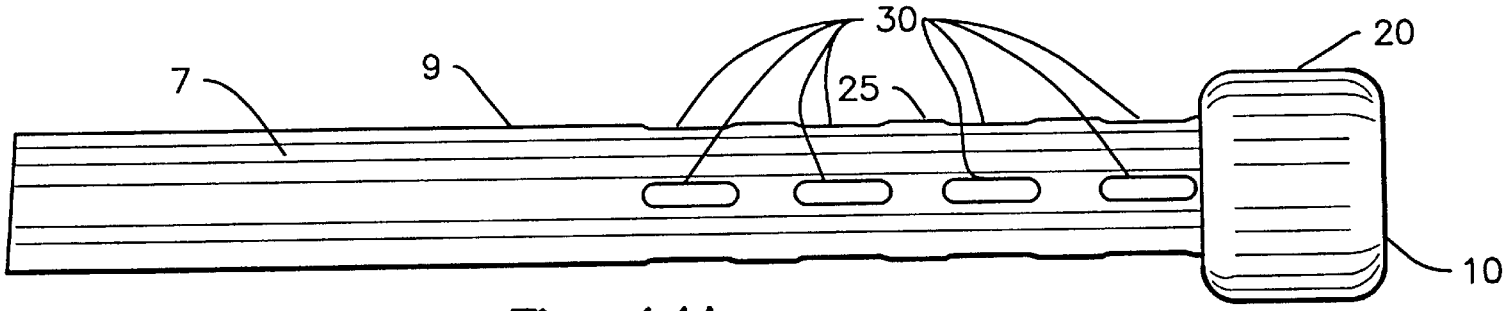
FIG. 14A shows the harmonic oscillator with harmonic oscillator mass, flexible cylinder extension, flexible cylinder extension wall, and flexible cylinder discontinuities in the form of slits.
Figure 14B:
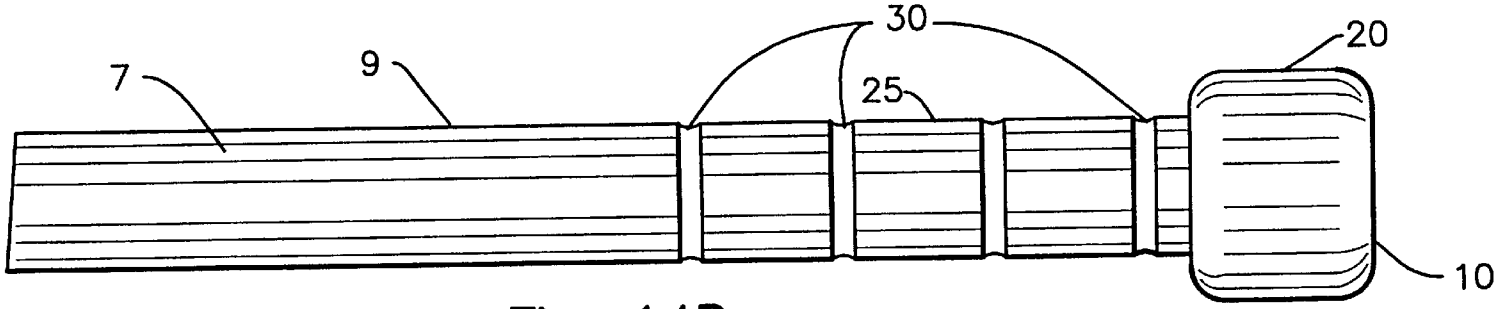
FIG. 14B shows the harmonic oscillator with harmonic oscillator mass, flexible cylinder extension, flexible cylinder extension wall, and flexible cylinder discontinuities in the form of grooves in the flexible cylinder extension wall.
Figure 15:
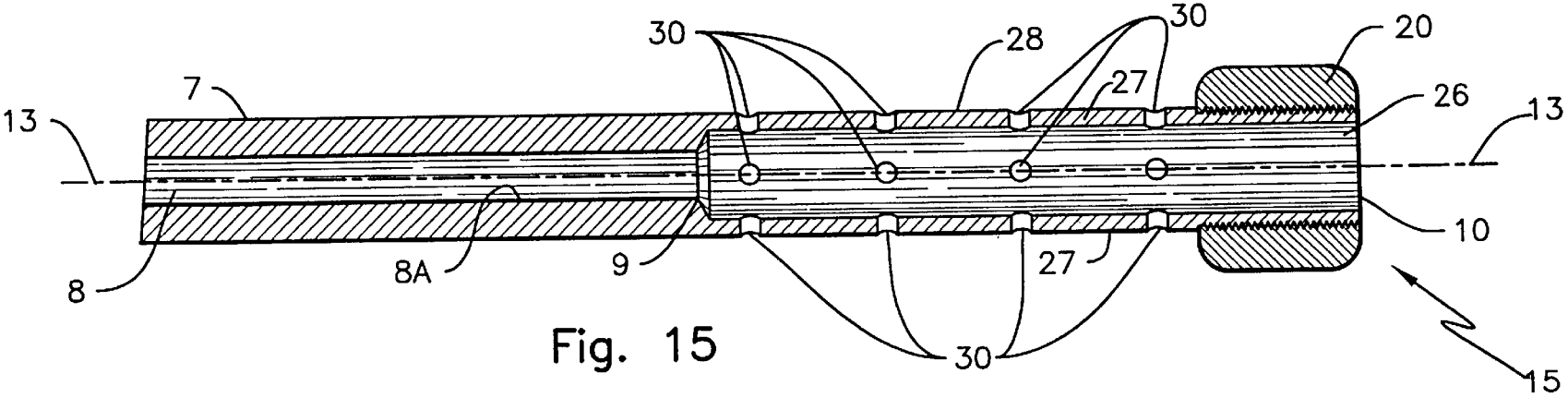
FIG. 15 shows section 15 from FIG. 14 showing the harmonic oscillator with harmonic oscillator mass, flexible cylinder extension, flexible cylinder extension wall, flexible cylinder discontinuities, flexible cylinder bore, barrel with barrel bore and barrel axis and with the harmonic oscillator mass affixed to the flexible cylinder extension with threaded means.
Figure 15A:
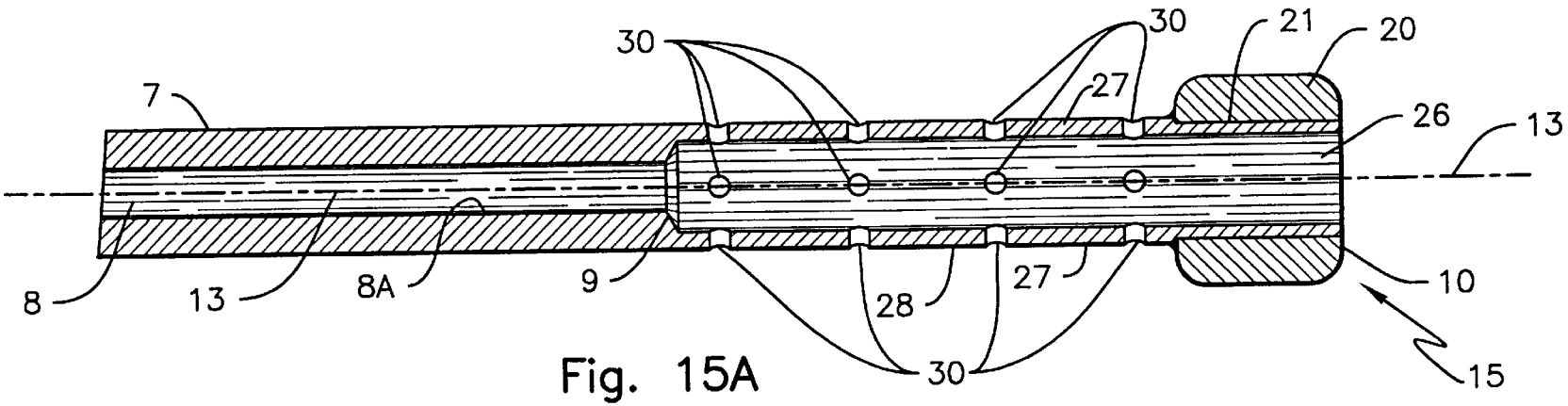
FIG. 15A shows section 15 from FIG. 14 showing the harmonic oscillator with harmonic oscillator mass, flexible cylinder extension, flexible cylinder extension wall, flexible cylinder discontinuities, flexible cylinder bore, barrel with barrel bore and barrel axis and with the harmonic oscillator mass affixed to the flexible cylinder extension with welded means.

The depiction of the flexible cylinder extension 15 as shown in FIGS. 14, 15 and 15A demonstrates flexible cylinder discontinuities 30 with a circular cross section. However, the function of the flexible cylinder discontinuities 30, to adjust or increase the flexibility of the flexible cylinder extension 15 will also be served with other configurations or cross sections including slits as depicted in FIG. 14A. The flexible cylinder discontinuities 30 may also be formed with circumferential grooves in the flexible cylinder extension 25 as shown in FIG. 14B. The flexible cylinder extension 25 may demonstrate a flexibility different from the barrel flexibility, as determined for a particular rifle barrel by design optimization, which will be determined by a function of the combination of material composing the flexible cylinder extension 25, the thickness of the flexible cylinder extension wall 27, the length of the flexible cylinder extension 25 and the configuration of flexible cylinder discontinuities 30. The second function of the harmonic oscillator mass 20 of the harmonic oscillator 15 is to provide an inertial mass at the barrel end 10 of the barrel 7 that will act in conjunction with inertial mass 40 to bend the barrel 7 between the inertial mass 40 and the muzzle 9 to be parallel to the bore axis 13 for lower frequencies such as the fundamental vibrational mode. The flexible cylinder extension 25 is affixed by means to the barrel 7 at the muzzle 9. Means of affixing the flexible cylinder extension 25 to the barrel 7 may be through welding, a threaded attachment, other connective means or as a part of the original manufacturing process as an extension of the barrel material.

The harmonic oscillator mass 20 is cylindrical in the preferred embodiment having a mass bore 21 which receives the flexible cylinder extension 25 at a position most distal from the muzzle 9. The harmonic oscillator mass 20 is not limited to a cylindrical form but may take any desired shape. The harmonic oscillator mass 20 receives and is affixed to the flexible cylinder extension 25 by means including threaded means as depicted in FIG. 15, welded means as depicted in FIG. 15A or other connective means.

A second component of the preferred embodiment is an inertial mass 40 having a perimeter 41 as shown as detail 8 of FIG. 1 and FIGS. 8, 8A, 9 and 9A. The inertial mass 40 is attached, formed or affixed to the barrel 7 at a point on the barrel 7 determined by specific analysis and design that will reduce the angular deflection of the muzzle most effectively, and preferably at a point for maximum reduction of said angle. The inertial mass 40 reduces the transmission of the short term vibrational response generated near the cartridge chamber 11 to the barrel 7 proximal the muzzle 9. The inertial mass 40 reacts in relationship to the harmonic oscillator 15, by bending the barrel 7 proximal the muzzle 9 reducing the dispersion angle at the muzzle 9. The inertial mass 40, in the preferred embodiment as shown in FIGS. 1, 8, 10, 11 and 12, is cylindrical having a first and second end 42, 43 and an inertial mass axis 44 centrally positioned and passing from the first to the second end 42, 43. A cylindrical inertial mass bore 46 extends from the first to the second end 42, 43 concentrically positioned in relation to the inertial mass axis 44. The inertial mass bore 46 is sized to receive a rifle barrel 7 or otherwise the cantilever portion of the device addressed by the user. Alternative embodiments of the inertial mass 40 will have shapes other than cylindrical which are dictated by design and esthetic values while accomplishing the function intended.

Figures 10, 11, 12, 13:
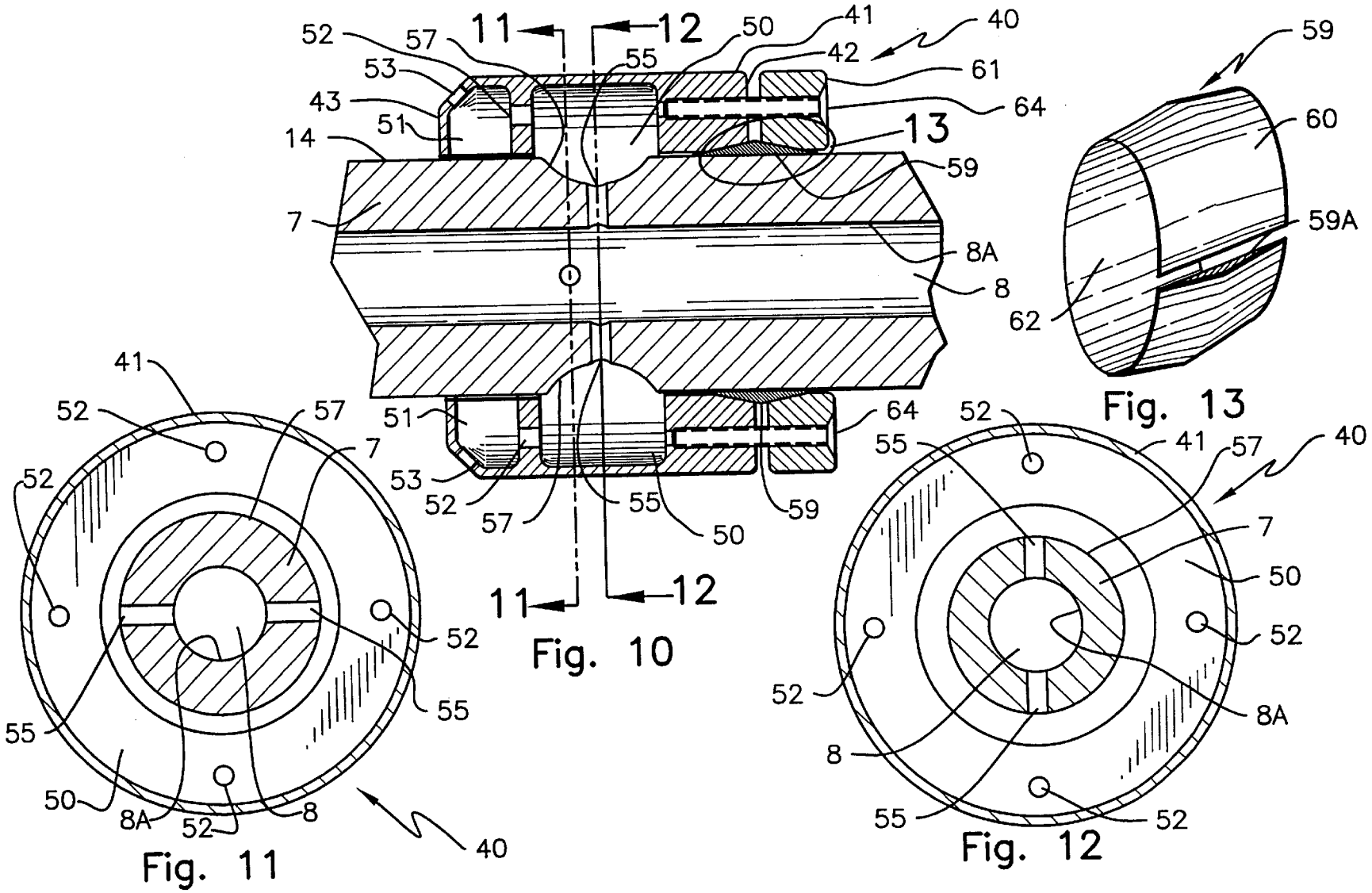
FIG. 10 demonstrates section 10 from FIG. 8 showing the inertial mass, perimeter, rifle barrel, discontinuity groove, discontinuity apertures, first and second annulus, first and second annulus gas ports. The method of retaining the inertial mass in place is shown by detail 13 in the use of a tapered split ring having a beveled surface, a ring gap and a spring function. The tapered split ring is bound by friction against the barrel by the force of a locking collar having a locking collar bore which bears against the beveled surface. The inertial mass bore bears against the beveled surface with retaining bolts securing the locking collar and inertial mass causing the tapered split ring to bind in place by friction. The inertial mass bore, proximal to the first end, and the locking collar will have a beveled surface to receive and bear against the tapered split ring.
FIG. 11 shows section 11 from FIG. 10 demonstrating the rifle barrel, discontinuity apertures from barrel bore to barrel surface and structural components of the inertial mass including discontinuity groove, first annulus, first annulus gas ports and inertial mass perimeter.
FIG. 12 shows section 12 from FIG. 10 demonstrating the rifle barrel, discontinuity apertures from barrel bore to barrel surface and structural components of the inertial mass including discontinuity groove, first annulus, first annulus gas ports and inertial mass perimeter.
FIG. 13 shows the tapered split ring as a means of securing the inertial mass in position. The beveled surface and ring gap are shown.

The inertial mass bore 46 has an interior perimeter 48 with at least a first annulus 50 formed at the interior perimeter 48. At least one circumferential discontinuity groove 57 is formed in the barrel surface 14 intermediate the cartridge chamber 11 and muzzle 9 positioned such that it is in pressure communication with the first annulus 50 when the inertial mass 40 is affixed at its barrel 7 position. The preferred embodiment will have a first and second annulus 50, 51 each forming a channel in the interior perimeter 48 circumnavigating the entirety of the interior perimeter 48 and in pressure communication with the barrel 7. In the preferred embodiment of the invention, the barrel 7 has discontinuity apertures 55 extending from the barrel bore 8 to the barrel surface 14 at the discontinuity groove 57 providing pressure communication from the barrel bore 8 to the first annulus 50 as depicted in FIG. 10. The at least one discontinuity groove 57 and discontinuity apertures 55 increase the barrel 7 flexibility and add to the effectiveness of the inertial mass 40 to decouple and isolate the vibrational transients, including short term vibrational transients, originating in the portion of barrel 7 proximal the cartridge chamber 11 from being transmitted to the muzzle 9. First annulus gas ports 52 allow pressure communication from the first annulus 50 to the second annulus 51 as shown in FIG. 10. Second annulus gas ports 53 allow pressure communication from the second annulus 51 to outside atmosphere as shown in FIG. 10. Cartridge combustion gasses are vented, in sequence, from discontinuity apertures 55 into the first annulus 50; from the first annulus 50 through first annulus gas ports 52 into the second annulus 51; and from the second annulus 51 through second annulus gas ports 53 to outside atmosphere. An alternative embodiment will have the inertial mass 40 configured with no gas porting and hence, in this embodiment, there will be no discontinuity aperture or groove 55, 57. Another alternative embodiment will have the inertial mass 40 positioned with gas porting functions in communication with at least one discontinuity aperture 55 with no discontinuity groove 57.

The inertial mass 40 is affixed to the barrel 7 by means. The inertial mass 40, as depicted in FIG. 1, may be formed integral with the machining or other formation of the barrel 7 or may be elements affixed to the barrel 7 in the form of components distinct from the manufacture of the barrel 7. The term 'affixed' used in conjunction with the inertial mass 40 includes formation integral to the manufacturing of the barrel 7 as well as the attachment of elements or components inherently separate from the barrel 7. In the preferred embodiment the inertial mass bore 46 receives a rifle barrel 7 such that either the first or second end 42, 43 is directed toward the muzzle 9. Means for affixing the inertial mass 40 to the barrel 7 in the preferred embodiment, as shown in FIG. 10, is by use of a locking collar 61. The method of retaining the inertial mass 40 in its position is shown by detail 13 in FIG. 10 in the use of a tapered split ring 59 having a beveled surface 60, a ring gap 59A and a spring function. The tapered split ring 59 is bound by friction against the barrel 7 by the force of a locking collar 61 having a locking collar bore 62 which bears against the beveled surface 60. The inertial mass bore 46 bears against the beveled surface 60 with retaining bolts securing the locking collar 61 and inertial mass 40 causing the tapered split ring 59 to bind in place by friction. The inertial mass bore 46, proximal to the first end 42, and the locking collar 61 may have a surface beveled to receive and bear against the tapered split ring 59 beveled surface 60. The inertial mass 40 may be affixed in position on the barrel 7 by other means including threaded means, welding, lock nuts, adhesives and other mechanical connective means.

The first function of the inertial mass 40 is to reduce the transmission of vibrations generated near the cartridge chamber 11 to a section of barrel 7 proximal the muzzle 9. The inertial mass 40 in its simplest form is solely a mass as shown in FIG. 1. The combination of inertial mass 40 with discontinuity apertures 55 and discontinuity groove 57 reflects the vibrational energy away from the section of barrel 7 proximal the muzzle 9 towards a position proximal the cartridge chamber 11 from a point intermediate the barrel muzzle 9 and the cartridge chamber 11 and thus prevents or reduces their transmission from the cartridge chamber 11 towards the muzzle 9. A second function of the inertial mass 40, in relationship to the harmonic oscillator 15, is to react to a lower frequency barrel 7 vibration by bending the portion of the barrel 7 proximal the muzzle 9 to reduce the angle of dispersion at the muzzle 9. A third function of the inertial mass 40 is to reduce gas pressure between the inertial mass 40 and muzzle 9 thus reducing the gas pressure against a bullet as it exits the muzzle 9. Discontinuity apertures 55 from the barrel bore 8 to the barrel surface 14 in the barrel 7 port gasses out of the barrel bore 8 at the inertial mass 40 thus relieving pressure that could deflect the orientation of the bullet as it exits the barrel 7 at the muzzle 9. A fourth function of the inertial mass 40 as configured is to reduce the pressure of the gasses ported from the barrel 7 at the second annulus gas ports 53. The configuration of porting cartridge combustion gasses, in sequence, from discontinuity apertures 55 into the first annulus 50; from the first annulus 50 through first annulus gas ports 52 into the second annulus 51; and from the second annulus 51 through second annulus gas ports 53 to outside atmosphere is with design intent to reduce gas jets normal to the bore axis 13. Gas jets normal to the bore axis 13 may well be unequal in their vertical and horizontal components thus deflecting the barrel. The configuration of the first and second annulus' 50, 51 and first and second annulus gas ports 52, 53 will be such as to vent combustion gasses away from normal to minimize any unwanted deflection of the barrel 7. The configuration of the inertial mass 40, when affixed at the barrel 7, may port combustion gasses either toward the muzzle 9 or the cartridge chamber 11. The orientation of the inertial mass 40, as depicted in FIG. 10 may be with the first end 42 toward the muzzle 9 or toward the cartridge chamber 11. Pressure reduction at the second annulus gas ports 53 is realized by the annulus and gas port configuration. The configuration demonstrated in FIG. 10 will yield the following results: the collective area of the second annulus gas ports 53 is greater than the collective area of the first annulus gas ports 52; the collective area of the first annulus gas ports 52 is greater than the collective area of the discontinuity apertures 55. The collective area of ports exiting an annulus are greater than the collective area of the ports entering that annulus. The combustion gasses escaping the last set of ports, shown as second annulus gas ports 53 in FIG. 10, will be directed at an angle as close to the bore axis 13 as possible. Thus, the component of forces produced by the escaping gasses normal to the barrel that would deflect the barrel are minimized.

The harmonic oscillator 15 is designed or tuned such that the harmonic oscillator 15 and that portion of the barrel 7 between the inertial mass 40 and the harmonic oscillator mass 20 function together as a unit so that vibrational energy transmitted past the inertial mass 40 forms a transient standing wave, between the inertial mass 40 and the harmonic oscillator mass 20. This functionality of forming a transient standing wave is optimized so that the said standing wave has a minimized slope, and thus a minimized dispersion angle, where the harmonic oscillator 15 is attached to the muzzle 9, for an extended window of bullet exit times.

A third component, shown as Detail 2 on FIG. 1, is a barrel spring suspension system 65. This component will not be required in certain applications involving in particular larger caliber guns for military applications. The function of the spring suspension system 65 is to first provide an adjustment of the vibrational coupling boundary conditions between the barrel 7 and the rifle stock 12. A biasing means having a spring function is secured between the barrel 7 and the rifle stock 12. The biasing means may be spring means including leaf, coil and other spring devices. Additional biasing means providing a spring function may be provided by the use of plastic, synthetic rubber or foam materials having resilient elastomeric characteristics. The barrel spring suspension system 65, in the preferred embodiment, is composed of a housing 70, generally cylindrical, comprised of a lower and upper housing 73, 76 each semicircular in cross section and affixed together, by means including mechanical and adhesive and provided for example, as in the preferred embodiment, by screws or bolts affixing the lower and upper housing 73, 76 together and to the rifle stock. The cylindrical housing 70 comprised of the lower and upper housing 73, 76 is composed of a rigid material provided, for example as in the preferred embodiment of metal. The barrel spring suspension system 65 housing 70 may well be composed of other rigid materials including composite materials, plastics and other rigid materials and may be of a one piece construction. The use of a lower and upper housing 73, 76 is for convenience in retrofitting of rifles and may not be the form preferred in an original manufacturing process. The lower and upper housing 73, 76 functions as the containment means, between barrel 7 and lower and upper housing 73, 76 for a biasing means providing a spring function or vibration coupling function between the barrel 7 and the rifle stock 12. Containment means may take forms other than the cylindrical housing 70 presented herein and is limited only in the need of securing a biasing means between barrel 7 and stock 12. The housing 70 is not limited to a cylindrical shape.

Figures 2, 3, 4, 5, 6, 7:
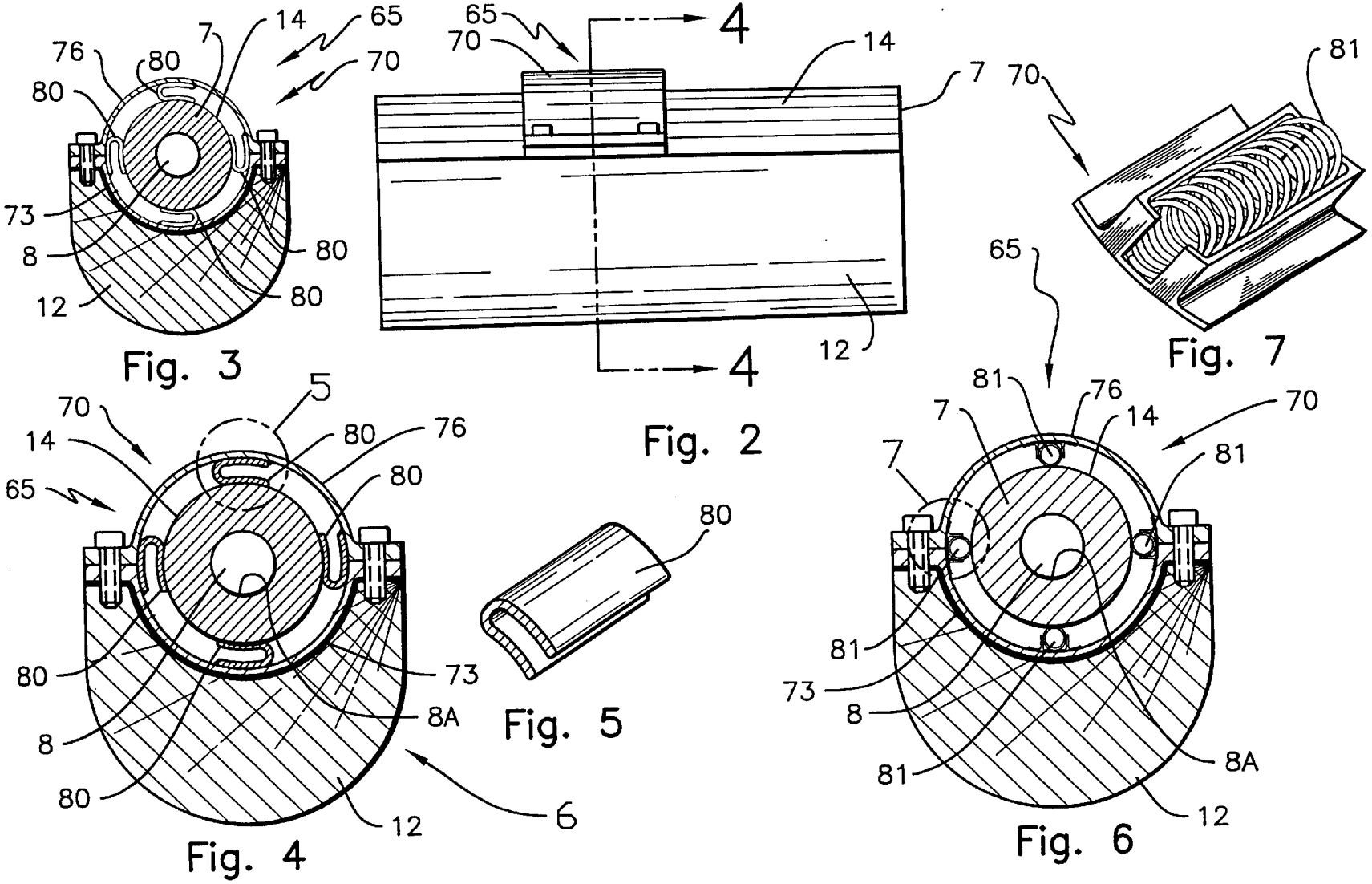
FIG. 2 is a side elevation of the barrel spring suspension system.
FIG. 3 is an end elevation of the barrel spring suspension system using leaf spring suspension showing the housing with components of upper and lower housings.
FIG. 4 is a section showing the barrel spring suspension system using leaf spring suspension and a cross section detail of a leaf spring.
FIG. 5 demonstrates a leaf spring.
FIG. 6 is an end elevation of the barrel spring suspension system using coil spring suspension showing the housing with components of upper and lower housings.
FIG. 7 is detail 7 from FIG. 6 showing the use of coil spring as suspension.
Figures 8, 8A, 9, 9A:
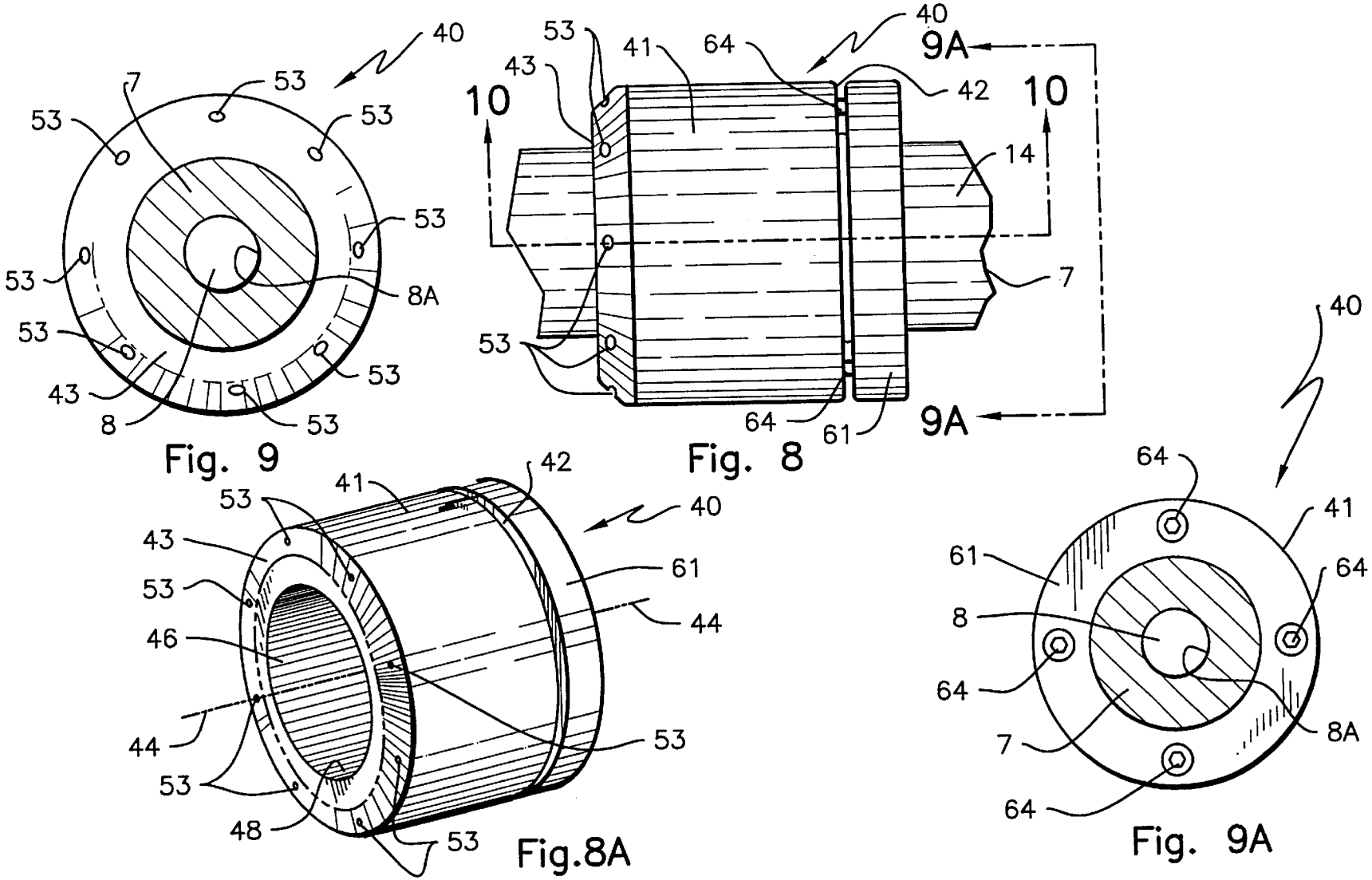
FIG. 8 shows the inertial mass showing the perimeter, first and second ends, second annulus gas port and rifle barrel.
FIG. 8A is an isometric representation of the inertial mass showing the perimeter, first and second ends, second annulus gas ports, inertial mass bore, inertial mass axis and interior perimeter.
FIG. 9 shows the inertial mass showing the second end, second annulus gas ports, rifle barrel and barrel bore.
FIG. 9A is a first end elevation showing the first end, retaining bolts, barrel and barrel bore.

The biasing means, of the spring suspension system 65, is provided in the preferred embodiment by at least one leaf spring 80 secured by means between the housing 70 and the barrel 7. The biasing means may be provided by a plurality of devices having a spring function and could be provided, for example, by a plurality of leaf or coil springs. In the preferred embodiment, as shown in FIGS. 3 and 4, a set of leaf springs 80 are secured by means between the housing 70 and the barrel 7 at the barrel surface 14. In the preferred embodiment, a set of four leaf springs 80, which may consist of sheet metal bent in a "U" shape, are affixed by means including welding, in opposing pairs, vertically and horizontally, between the barrel 7 and housing 70. The leaf spring 80 constants are adjusted in the vertical and horizontal directions by cutting each leaf spring 80 to the desired length. This adjustment of the vibrational coupling boundary conditions provides more control in the vibrational relationship between the barrel 7 and stock 12. A second function of the barrel spring suspension system 65 is to provide an adjustment to the short term vibrational response of the barrel 7. Utilization of the barrel spring suspension system 65 increases the vibrational frequency of the vibrations and more quickly defines the states of the short term vibrational response during the short time interval between powder ignition and the time the bullet leaves the muzzle 9. In an alternative embodiment the biasing means may be provided, as shown in FIG. 6, by a coil spring 81, affixed by means between the housing 70 and barrel 7.

In addition to the rifle barrel application described herein, the principle of the harmonic oscillator, the inertial mass and barrel discontinuities, and in some applications, the barrel spring suspension system, can be applied to large military weapons that fire a single round, such as tanks, naval rifles, or large field guns, and future weapons systems such as rail guns. The vibrations in the barrels or structure that lead to inaccuracy can be controlled by the features of the rifle barrel application as they are described herein.

Figure 16:
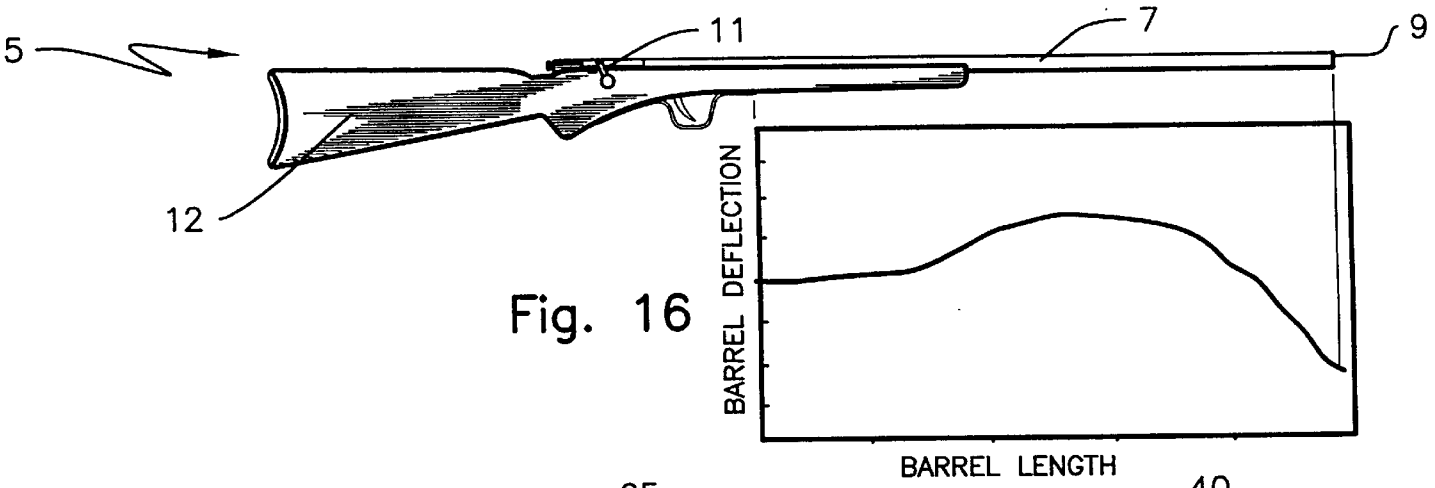
FIG. 16 shows an example of a computer simulation of the transient vibrational response (transverse displacement) at a time coincident with a bullet leaving the muzzle. This is a depiction of the expected response without use of the subject invention.
Figure 17:
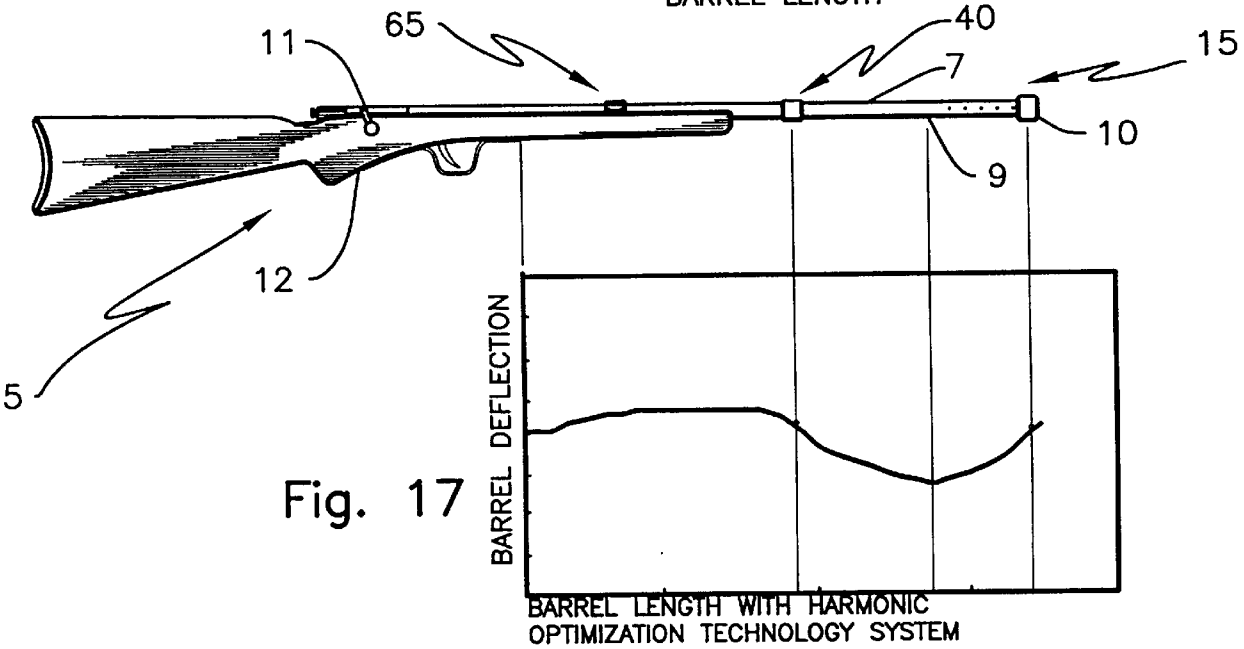
FIG. 17 shows an example of a computer simulation of the transient vibrational response or short term vibrational response (transverse displacement), with the harmonic optimization technology for rifles, at a time coincident with a bullet leaving the muzzle. The slope of this curve at the muzzle (the point where the bullet loses physical contact with the barrel) is thus controlled to remain more parallel to the baseline bore axis as compared to FIG. 16, demonstrating a reduced angular dispersion.
Figure 18:
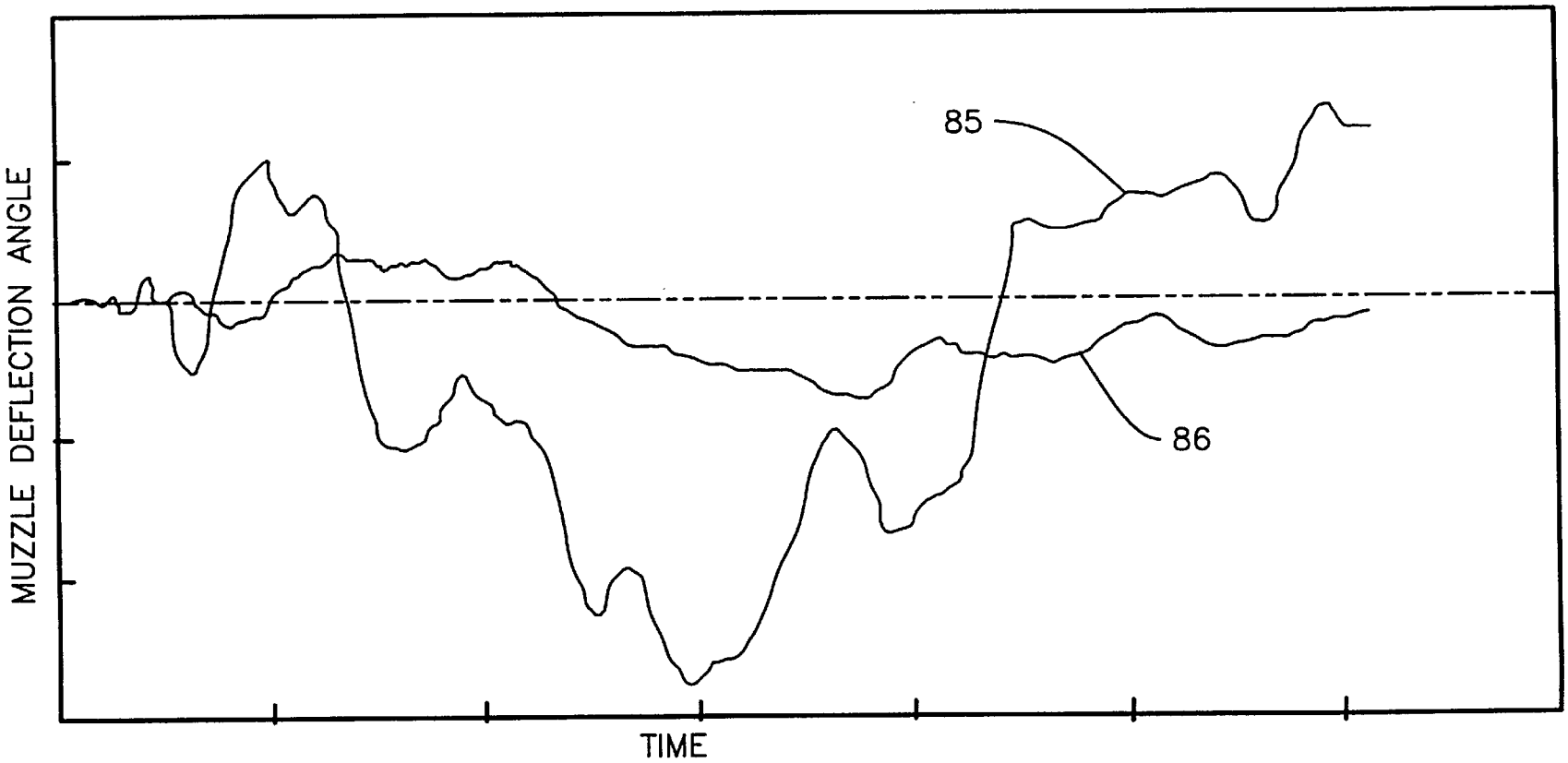
FIG. 18 shows a comparison of the computer simulations resulting in predictions of the slope of the barrel at the muzzle plotted against a time interval that includes the exit time of the bullet at the muzzle. This slope is proportional to dispersion angle. With the addition of the current invention, this dispersion angle is reduced significantly for all relevant time.

Computer simulations of the transient vibrational response (transverse displacement), in a rifle barrel 7 at a time coincident with a bullet leaving the muzzle 9 is shown in FIG. 16. FIG. 16 is a depiction of the expected response without use of the subject invention. FIG. 17 depicts a computer simulation of the transient vibrational response (transverse displacement), with the harmonic optimization system for rifles, at a time coincident with a bullet leaving the muzzle 9. The slope of this curve at the muzzle 9 is thus controlled to remain more parallel to the baseline bore axis 13 as compared to FIG. 16 demonstrating a reduced angular dispersion. FIG. 18 first curve 85 depicts a computer simulation, without use of the present invention, resulting in predictions of the slope of the barrel 7 at the muzzle 9 plotted against a time interval that includes the exit time of the bullet at the muzzle 9. Curve 86 demonstrates the reduction of dispersion angle for all relevant time as the result of installation of the disclosed invention on a rifle barrel 7. The curves 85 and 86 are proportional to the dispersion angle at the muzzle 9 as a function of time.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A harmonic optimization technology system comprising:

A. a harmonic oscillator affixed by means at a muzzle of a rifle barrel; the barrel having a bore, a bore axis, a barrel surface, a bore surface and a rifle cartridge chamber; the cartridge chamber distal from the muzzle; the barrel having a short term vibrational response, to the combustion of a cartridge in the cartridge chamber and to the transit of a bullet through the barrel; the muzzle having a dispersion angle relative to the bore axis; the harmonic oscillator having harmonic oscillator mass, wall thickness, material composition, extension length and flexible cylinder discontinuities;

B. an inertial mass affixed by means intermediate the rifle cartridge chamber and the muzzle; the inertial mass reducing the transmission of the short term vibrational response generated near the cartridge chamber to the barrel proximal the muzzle; the inertial mass, in relationship to the harmonic oscillator, bending the barrel proximal the muzzle thereby reducing the dispersion angle at the muzzle; the harmonic oscillator is tuned producing a standing wave, corresponding to the frequency of the short term vibrational response, between the inertial mass and the harmonic oscillator mass, that bends the barrel proximal to the muzzle, so that the muzzle dispersion angle is minimized;

C. a barrel spring suspension system having means, affixed proximal the cartridge chamber intermediate the cartridge chamber and the inertial mass, for biasing and vibrational coupling between the barrel and a rifle stock; vibrational coupling boundary conditions existing between the barrel and the rifle stock; the barrel spring suspension system thereby providing an adjustment of said vibrational coupling boundary conditions and an adjustment to the short term vibrational response of the barrel; and D. wherein a rifle with any ammunition load achieves improved bullet accuracy by reducing the magnitude of the barrel muzzle dispersion angle caused by short term vibrational response.

2. A harmonic optimization technology system according to claim 1 wherein:

A. the harmonic oscillator is composed of the harmonic oscillator mass and a flexible cylinder extension; the flexible cylinder extension is affixed by means to the barrel at the muzzle; the harmonic oscillator mass affixed by means to the flexible cylinder extension at a point most distal to the muzzle; the flexible cylinder extension having a flexible cylinder extension wall with a thickness wherein changes in the flexible cylinder extension wall thickness and length of the flexible cylinder extension adjust flexibility of the flexible cylinder extension in the vertical and horizontal directions; flexible cylinder discontinuities at the flexible cylinder extension varies the flexibility of the flexible cylinder extension in relation to the flexibility of the barrel; the flexible cylinder extension has a flexible cylinder bore and a flexible cylinder extension surface; and the harmonic oscillator mass having a mass bore with connective means which receives the flexible cylinder extension;

B. the inertial mass is affixed by means to the barrel at a point for maximum reduction of the dispersion angle of the muzzle; the inertial mass having a first and second end and an inertial mass axis centrally positioned and passing from the first to the second end; an inertial mass bore extends from the first to the second end concentrically positioned in relation to the inertial mass axis; and said bore is of a size to receive a rifle barrel; and C. the barrel spring suspension system is composed of a housing of a rigid material; the housing providing a containing means, between the barrel and the housing, of the biasing means; the biasing means providing a spring function between the barrel and the rifle stock.

3. A harmonic optimization technology system according to claim 2 wherein:

A. said flexible cylinder discontinuities are penetrations through the flexible cylinder extension wall from the flexible extension bore to the flexible cylinder extension surface;

B. the inertial mass bore has an interior perimeter with at least a first annulus formed at the interior perimeter; at least one circumferential discontinuity groove is formed in the barrel surface intermediate the cartridge chamber and muzzle positioned such that the at least one circumferential discontinuity groove is in pressure communication with the first annulus when the inertial mass is affixed; the at least first annulus forming a channel in the interior perimeter in pressure communication with the barrel at the discontinuity groove; at least one discontinuity aperture extending from the barrel bore to the barrel surface at the discontinuity groove thereby providing pressure communication from the barrel bore to the at least first annulus; the at least one discontinuity groove and the at least one discontinuity aperture increasing the barrel flexibility and increasing the effectiveness of the inertial mass in decoupling and isolating short term vibrational responses from being transmitted to the muzzle; at least one first annulus gas port having exiting pressure communication from the at least first annulus; and C. the housing comprised of a lower and upper housing; the lower and upper housing being semi-circular in cross section and affixed together and to the rifle stock by means; the housing is comprised of metal.

4. A harmonic optimization technology system according to claim 3 wherein: interior perimeter and in pressure communication with the barrel; the first annulus in pressure communication with the at least one discontinuity groove and the at least one discontinuity aperture; the at least one first annulus gas port in pressure communication with the second annulus; at least one second annulus gas port allows pressure communication from the second annulus to outside atmosphere; the means affixing the inertial mass to the barrel composed of a tapered split ring having a beveled surface, a ring gap and a spring function; the tapered split ring is bound by friction against the barrel by the force of a locking collar having a locking collar bore which bears against the beveled surface; and the inertial mass bore bears against the beveled surface with retaining bolts securing the locking collar and inertial mass causing the tapered split ring to bind in place by friction.

5. A harmonic optimization technology system according to claim 4 wherein:

A. the first annulus is in pressure communication with a plurality of discontinuity apertures; the plurality of discontinuity apertures having a collective area; a plurality of first annulus gas ports allow pressure communication from the first annulus to the second annulus; the plurality of first annulus gas ports having a collective area; a plurality of second annulus gas ports allow pressure communication from the second annulus to outside atmosphere; the plurality of second annulus gas ports having a collective area; the plurality of second annulus gas ports oriented away from normal to the bore axis; whereby the relationship of the collective areas of the plurality of discontinuity apertures, first annulus gas ports and second annulus gas ports causes a pressure reduction from the barrel to the outside atmosphere.

6. A harmonic optimization technology system according to claim 2 wherein:

A. the biasing means of the spring suspension system is comprised of at least one leaf spring secured by means between the housing and the barrel.

7. A harmonic optimization technology system according to claim 6 wherein:

A. said biasing means is composed of a plurality of leaf springs.

8. A harmonic optimization technology system according to claim 2 wherein:

A. the biasing means of the spring suspension system is comprised of at least one coil spring secured by means between the housing and the barrel.

9. A harmonic optimization technology system comprising:

A. a harmonic oscillator affixed by means at a muzzle of a gun barrel; the barrel having a a bore, axis a barrel surface, a bore surface and a cartridge chamber; the cartridge chamber distal from the muzzle; the barrel having a short term vibrational response to the combustion of a cartridge in the cartridge chamber and to the transit of a bullet through the barrel; the muzzle having a dispersion angle relative to the bore axis; the harmonic oscillator having harmonic oscillator mass, wall thickness, material composition, extension length and flexible cylinder discontinuities;

B. an inertial mass affixed intermediate a cartridge chamber and the muzzle; the inertial mass reducing the transmission of short term vibration response generated near the cartridge chamber to the barrel proximal the muzzle; the inertial mass, in relationship to the harmonic oscillator, bending the portion of the barrel proximal the muzzle thereby reducing the dispersion angle at the muzzle; the harmonic oscillator is tuned producing a standing wave, corresponding to the frequency of the short term vibrational response, between the inertial mass and the harmonic oscillator mass, that bends the barrel proximal to the muzzle so that the muzzle dispersion angle remains parallel with the bore axis; and C. wherein a gun with any ammunition load achieves improved projectile accuracy by reducing the magnitude of the barrel muzzle dispersion angle caused by short term vibrational response.

10. A harmonic optimization technology system according to claim 9 wherein:

A. the harmonic oscillator is composed of the harmonic oscillator mass and a flexible cylinder extension; the flexible cylinder extension is affixed by means to the barrel at the muzzle; the harmonic oscillator mass affixed by means to the flexible cylinder extension at a point most distal to the muzzle; the flexible cylinder extension having a flexible cylinder extension wall with a thickness wherein changes in the flexible cylinder extension wall thickness and length of the flexible cylinder extension adjust flexibility of the flexible cylinder extension in the vertical and horizontal directions; flexible cylinder discontinuities at the flexible cylinder extension adjusts the flexibility of the flexible cylinder extension in relation to the flexibility of the barrel; the flexible cylinder extension has a flexible cylinder bore and a flexible cylinder extension surface; and the harmonic oscillator mass having a mass bore with connective means which receives the flexible cylinder extension; and B. the inertial mass is affixed by means to the barrel at a point for maximum reduction of the dispersion angle of the muzzle; the inertial mass having a first and second end and an inertial mass axis centrally positioned and passing from the first to the second end; an inertial mass bore extends from the first to the second end concentrically positioned in relation to the inertial mass axis; and the inertial mass bore is of a size to receive a gun barrel.

11. A harmonic optimization technology system according to claim 10 wherein:

A. said flexible cylinder discontinuities are penetrations through the flexible cylinder extension wall from the flexible extension bore to the flexible cylinder extension surface; and B. the inertial mass bore has an interior perimeter with at least a first annulus formed at the interior perimeter; at least one circumferential discontinuity groove is formed in the barrel surface intermediate the cartridge chamber and muzzle positioned such that the at least one circumferential discontinuity groove is in pressure communication with the first annulus when the inertial mass is affixed; the at least first annulus forming a channel in the interior perimeter in pressure communication with the barrel at the discontinuity groove; at least one discontinuity aperture extending from the barrel bore to the barrel surface at the discontinuity groove in pressure communication from the barrel bore to the at least first annulus; the at least one discontinuity groove and the at least one discontinuity aperture increasing the barrel flexibility and increasing the effectiveness of the inertial mass in decoupling and isolating short term vibrational transients from being transmitted to the muzzle; and at least one first annulus gas port having exiting pressure communication from the at least first annulus.

12. A harmonic optimization technology system according to claim 11 wherein:

A. said inertial mass has a first and second annulus each forming a channel in the interior perimeter and in pressure communication with the barrel; the first annulus in pressure communication with the at least one discontinuity groove and the at least one discontinuity aperture; the at least one first annulus gas port in pressure communication with the second annulus; at least one second annulus gas port allows pressure communication from the second annulus to outside atmosphere; the friction means affixing the inertial mass to the barrel composed of a tapered split ring having a beveled surface, a ring gap and a spring function; the tapered split ring is bound by friction against the barrel by the force of a locking collar having a locking collar bore which bears against the beveled surface; and the inertial mass bore bears against the beveled surface with retaining bolts securing the locking collar and inertial mass causing the tapered split ring to bind in place by friction.

13. A harmonic optimization technology system according to claim 12 wherein:

A. the first annulus is in pressure communication with a plurality of discontinuity apertures; the plurality of discontinuity apertures having a collective area; a plurality of first annulus gas ports allow pressure communication from the first annulus to the second annulus; the plurality of first annulus gas ports having a collective area; a plurality of second annulus gas ports allow pressure communication from the second annulus to outside atmosphere; the plurality of second annulus gas ports having a collective area; the plurality of second annulus gas ports oriented away from normal to the bore axis; whereby the relationship of the collective areas of the plurality of discontinuity apertures, first annulus gas ports and second annulus gas ports causes a pressure reduction from the barrel to the outside atmosphere.

14. A harmonic optimization technology system comprising:

A. a rifle having a barrel; the barrel having a cartridge chamber, a muzzle at the barrel distal from the cartridge chamber, a bore, a bore axis, a barrel surface and a bore surface; the barrel having a short term vibrational response to the combustion of a cartridge in the cartridge chamber and to the transit of a bullet through the barrel; the muzzle having a dispersion angle relative to the bore axis;

B. a harmonic oscillator affixed by means at the muzzle; the harmonic oscillator having harmonic oscillator mass, wall thickness, material composition, extension length and flexible cylinder discontinuities;

C. an inertial mass affixed by means intermediate the rifle cartridge chamber and the muzzle; the inertial mass reducing the transmission of short term vibrational response generated near the cartridge chamber to the barrel proximal the muzzle; the harmonic oscillator is tuned producing a standing wave, corresponding to the frequency of the short term vibrational response, between the inertial mass and the harmonic oscillator mass; and D. a barrel spring suspension system having means, affixed proximal the cartridge chamber intermediate the cartridge chamber and the inertial mass, for biasing between the barrel and a rifle stock.

15. A harmonic optimization technology system according to claim 14 wherein:

A. the harmonic oscillator is composed of the harmonic oscillator mass and a flexible cylinder extension; the flexible cylinder extension has a flexible cylinder bore concentric with the barrel bore having the barrel bore axis; the flexible cylinder extension affixed by means to the muzzle; the harmonic oscillator mass affixed by means to the flexible cylinder extension at a position distal to the muzzle; the flexible cylinder extension having flexible cylinder discontinLities; the harmonic oscillator tuned by adjustments of the mass of harmonic oscillator mass, flexible cylinder extension wall thickness and material composition, flexible cylinder extension length, and character of flexible cylinder discontinuities;

B. the inertial mass is affixed by means to the barrel at a point for maximum reduction of the dispersion angle of the muzzle; and C. the barrel spring suspension system is composed of a housing of a rigid material, thereby providing a containing means, between the barrel and the housing, for said biasing means.

16. A harmonic optimization technology system according to claim 15 wherein:

A. the flexible cylinder extension differs in flexibility from the barrel as a function of the thickness of a flexible cylinder extension wall, the length of the flexible cylinder extension; the harmonic oscillator mass having a mass bore with connective means which receives the flexible cylinder extension; the flexible cylinder extension having an area moment relative to the area moment of the barrel; the flexible cylinder discontinuities change the area moment of the flexible cylinder extension relative to the area moment of the barrel thus changing the relative flexibility and reflecting vibrational energy; and B. the inertial mass having a first and second end and an inertial mass axis centrally positioned and passing from the first to the second end; an inertial mass bore extends from the first to the second end concentrically positioned in relation to the inertial mass axis; the inertial mass bore is of a size to receive a rifle barrel.

17. A harmonic optimization technology system according to claim 16 wherein:

A. said flexible cylinder extension has flexible cylinder discontinuities thereby adjusting the flexibility of the flexible cylinder extension in relation to the flexibility of the barrel; the flexible cylinder extension has a flexible cylinder bore and a flexible cylinder extension surface; the flexible cylinder discontinuities composed of penetrations through the flexible cylinder extension wall.

18. A harmonic optimization technology system according to claim 16 wherein:

A. said flexible cylinder extension has flexible cylinder discontinuities thereby adjusting the flexibility of the flexible cylinder extension in relation to the flexibility of the barrel; the flexible cylinder extension has a flexible cylinder bore and a flexible cylinder extension surface; the flexible cylinder discontinuities composed of grooves in the flexible cylinder extension surface.

19. In a device of claim 1, claim 4 or claim 14, from which at projectile is fired or launched through a barrel having a muzzle, the barrel having a short term vibirational response to the launching and the transit of the projectile through the barrel, a method of improving accurracy and controlling barrel vibration, said method comprises the steps of:

A. partially decoupling and isolating the vibrations, thereby reducing vibration transmnission to the muzzle;

B. modifying the vibrations so that the angular dispersion at the muzzle, which gives final direction to the projectile, is minimized; and C. reducing the pressures of expanding gases on the back of the projectile as it exits the muzzle, thereby preventing undue upset on the projectile's angle of flight and axis of rotation.

20. The method of claim 19 wherein the method of step B comprises tuning the barrel to produce a standing wave, corresponding to the frequency of the short term vibrational response, in response to barrel vibrations that bend the barrel proximal to the muzzle.

21. The method of claim 19 wherein the device is a rifle comprising a barrel and a rifle stock, said method further comprises the step of:

a. adjusting the vibrational boundary conditions between the barrel and the rifle stock.

* * * * *